US009562492B2

(12) United States Patent
Nomura

(10) Patent No.: US 9,562,492 B2
(45) Date of Patent: Feb. 7, 2017

(54) INTERNAL COMBUSTION ENGINE

(71) Applicant: Atsushi Nomura, Nagakute (JP)

(72) Inventor: Atsushi Nomura, Nagakute (JP)

(73) Assignee: TOYOTA JIDOSHA KABUSHIKI KAISHA, Tokyo (JP)

( * ) Notice: Subject to any disclaimer, the term of this patent is extended or adjusted under 35 U.S.C. 154(b) by 143 days.

(21) Appl. No.: 14/436,734

(22) PCT Filed: Jan. 27, 2014

(86) PCT No.: PCT/IB2014/000190
§ 371 (c)(1),
(2) Date: Apr. 17, 2015

(87) PCT Pub. No.: WO2014/118627
PCT Pub. Date: Aug. 7, 2014

(65) Prior Publication Data

US 2015/0247472 A1 Sep. 3, 2015

(30) Foreign Application Priority Data

Jan. 31, 2013 (JP) ..... 2013-017107

(51) Int. Cl.
*F02F 1/36* (2006.01)
*F02F 1/14* (2006.01)
(Continued)

(52) U.S. Cl.
CPC .. *F02F 1/14* (2013.01); *F01P 3/02* (2013.01); *F02F 1/16* (2013.01); *F02F 1/40* (2013.01); *F01P 2003/028* (2013.01)

(58) Field of Classification Search
CPC ..... F02F 1/14; F02F 1/16; F02F 1/40; F02F 1/26; F01P 3/02; F01P 2003/028
(Continued)

(56) References Cited

U.S. PATENT DOCUMENTS 4,381,736 A * 5/1983 Hirayama ..... F01P 7/164 123/41.1
5,386,805 A 2/1995 Abe et al.
(Continued)

FOREIGN PATENT DOCUMENTS

JP 02125951 A * 5/1990
JP H05-010124 A 1/1993
(Continued)

*Primary Examiner* — Hung Q Nguyen
(74) *Attorney, Agent, or Firm* — Oliff PLC

(57) ABSTRACT

An internal combustion engine includes: a cylinder block having a block cooling water passage that supplies cooling water to a plurality of cylinder bores, and an inter-bore cooling water passage provided between cylinder bores that supplies cooling water between the cylinder bores; a cylinder head having a first cooling water passage to which cooling water is supplied from the block cooling water passage, and a second cooling water passage, which is provided independently from the first cooling water passage, and to which cooling water is supplied from the inter-bore cooling water passage; a heat exchanger; a first cooling water introducing part that leads cooling water, which is flown out from the first cooling water passage, to the heat exchanger; and a second cooling water introducing part that leads cooling water, which is flown out from the second cooling water passage, to a downstream side of the heat exchanger.

3 Claims, 4 Drawing Sheets

(51) Int. Cl.

| | |
|---|---|
| ***F01P 3/02*** | (2006.01) |
| ***F02F 1/16*** | (2006.01) |
| ***F02F 1/40*** | (2006.01) |

(58) Field of Classification Search
USPC ..... 123/41.28, 41.29, 41.32, 41.09, 41.72, 123/41.79, 41.82 R
See application file for complete search history.

(56) References Cited

U.S. PATENT DOCUMENTS

| | | | | |
|---|---|---|---|---|
| 5,894,834 | A * | 4/1999 | Kim | F01N 5/02 123/41.29 |
| 6,901,891 | B2 * | 6/2005 | Suzuki | F01M 11/02 123/193.3 |
| 6,976,683 | B2 * | 12/2005 | Eckert | F01P 3/02 277/591 |
| 9,068,496 | B2 * | 6/2015 | Beyer | F01P 3/02 |
| 2010/0326380 | A1 * | 12/2010 | Fedeson | F01P 3/02 123/41.82 R |
| 2011/0011568 | A1 | 1/2011 | Han et al. | |
| 2011/0023799 | A1 * | 2/2011 | Lenz | F01P 3/02 123/41.79 |

FOREIGN PATENT DOCUMENTS

| | | | |
|---|---|---|---|
| JP | 2002-168147 | A | 6/2002 |
| JP | 2002-180831 | A | 6/2002 |
| JP | 2003-184642 | A | 7/2003 |
| JP | 2003-193836 | A | 7/2003 |
| JP | 2011-517757 | A | 6/2011 |
| JP | 2011-202634 | A | 10/2011 |

* cited by examiner

INTERNAL COMBUSTION ENGINE

BACKGROUND OF THE INVENTION

1. Field of the Invention

The invention relates to an internal combustion engine having a cylinder head with a plurality of independent cooling water passages.

2. Description of Related Art

In an internal combustion engine, since it is difficult to form a block water jacket between cylinder bores in a high-temperature cylinder block, a inter-bore cooling water passage provided between cylinder bores, which is made of a drilled hole or the like, is formed between cylinder bores, and cooling water is introduced from a block water jacket into the inter-bore cooling water passage.

An internal combustion engine is disclosed, in which a block cooling water passage is communicated with an upper stage water jacket in a cylinder head through a inter-bore cooling water passage in order to cool a part between cylinder bores effectively (for example, Japanese Patent Application Publication No. 2002-168147 A (JP 2002-168147 A)).

In the internal combustion engine, after a lower part of the cylinder head, which faces a high-temperature combustion chamber, is cooled by a lower stage water jacket, cooling water in the lower stage water jacket is supplied to the upper stage water jacket.

Therefore, by leading the inter-bore cooling water passage to the upper stage water jacket having lower pressure than that of the lower stage water jacket, differential pressure between the block cooling water passage and the upper stage water jacket is increased, and thus a flow rate (flow velocity) in the inter-bore cooling water passage is increased, thereby improving cooling performance between cylinder bores.

SUMMARY OF THE INVENTION

However, in the internal combustion engine stated above, it is thought that cooling water flown out from the upper stage water jacket circulates to the internal combustion engine through a heat exchanger such as a radiator. Therefore, flow resistance is increased when cooling water, which is flown out from the upper stage water jacket, flows through the radiator.

Therefore, it is not possible to increase differential pressure between the upper stage water jacket and the block water jacket, and it is impossible to sufficiently increase a flow rate of cooling water that flows through the inter-bore cooling water passage. As a result, there is a possibility that cooling performance for the inter-bore cooling water passage cannot be improved.

The present invention provides an internal combustion engine that is able to increase a flow rate of cooling water flowing through the inter-bore cooling water passage, and improve cooling performance between cylinder bores.

An internal combustion engine according to an aspect of the present invention includes: a cylinder block having a block cooling water passage that supplies cooling water to a plurality of cylinder bores, and a inter-bore cooling water passage provided between cylinder bores that supplies cooling water between the cylinder bores; a cylinder head having a first cooling water passage to which cooling water is supplied from the block cooling water passage, and a second cooling water passage, which is provided independently from the first cooling water passage, and to which cooling water is supplied from the inter-bore cooling water passage; a heat exchanger; a first cooling water introducing part that leads cooling water, which is flown out from the first cooling water passage, to the heat exchanger; and a second cooling water introducing part that leads cooling water, which is flown out from the second cooling water passage, to a downstream side of the heat exchanger.

Since the internal combustion engine according to the above-mentioned aspect includes the first cooling water introducing part that leads cooling water, which is flown out from the first cooling water passage of the cylinder head, to the heat exchanger, and the second cooling water introducing part that leads cooling water, which is flown out from the second cooling water passage of the cylinder head through the inter-bore cooling water passage, to the downstream side of the heat exchanger, cooling water flown out from the first cooling water passage receives resistance of the heat exchanger, and cooling water flown out from the second cooling water passage does not receive resistance of the heat exchanger. Therefore, it is possible to reduce flow resistance of cooling water flowing through the second cooling water passage to be smaller than flow resistance of cooling water flowing through the first cooling water passage.

Therefore, it becomes possible to increase differential pressure between the block cooling water passage and the second cooling water passage to be larger than differential pressure between the block cooling water passage and the first cooling water passage, and flow velocity of cooling water flowing through the inter-bore cooling water passage is increased, thus increasing a flow rate of cooling water flowing through the inter-bore cooling water passage. As a result, it is possible to improve cooling performance for a part between cylinder bores, temperature of which becomes high.

In the internal combustion engine of the foregoing aspect, the first cooling water passage includes a lower stage cooling water passage that is provided adjacent to a combustion chamber defined by upper portions of the cylinder bores and a lower portion of the cylinder head, and an upper stage cooling water passage that is communicated with the lower stage cooling water passage and provided above the lower stage cooling water passage, and the first cooling water introducing part may lead cooling water, which is flown out from the upper stage cooling water passage and the lower stage cooling water passage, to the heat exchanger.

In the internal combustion engine with the foregoing structure, the first cooling water passage is structured from the lower stage cooling water passage provided adjacent to the combustion chamber, and the upper stage cooling water passage that is communicated with the lower stage cooling water passage and provided above the lower stage cooling water passage. Therefore, for example, by reducing a passage area of the lower stage cooling water passage to be smaller than a passage area of the upper stage cooling water passage, it is possible to increase flow velocity of cooling water flowing through the lower stage cooling water passage. Hence, it is possible to proactively cool a part of the cylinder head adjacent to the combustion chamber, temperature of which is increased, thus improving cooling performance for the cylinder head.

In the internal combustion engine according to the foregoing aspect, the heat exchanger may be a radiator that has a tube through which cooling water flows, and exchanges heat between a coolant and the cooling water.

Since the heat exchanger of the internal combustion engine is structured from the radiator having the tube through which cooling water flows, flow resistance of cooling water flowing through the tube of the radiator is increased. Thus, by providing the second cooling water introducing part that leads cooling water, which is flown out from the second cooling water passage, to the downstream side of the heat exchanger, it becomes possible to reduce flow resistance of cooling water flowing through the second cooling water passage to be smaller than flow resistance of cooling water flowing through the first cooling water passage.

According to the aspect of the present invention, it is possible to provide an internal combustion engine that is able to increase a flow rate of cooling water flowing through the inter-bore cooling water passage, and improve cooling performance for the part between cylinder bores.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
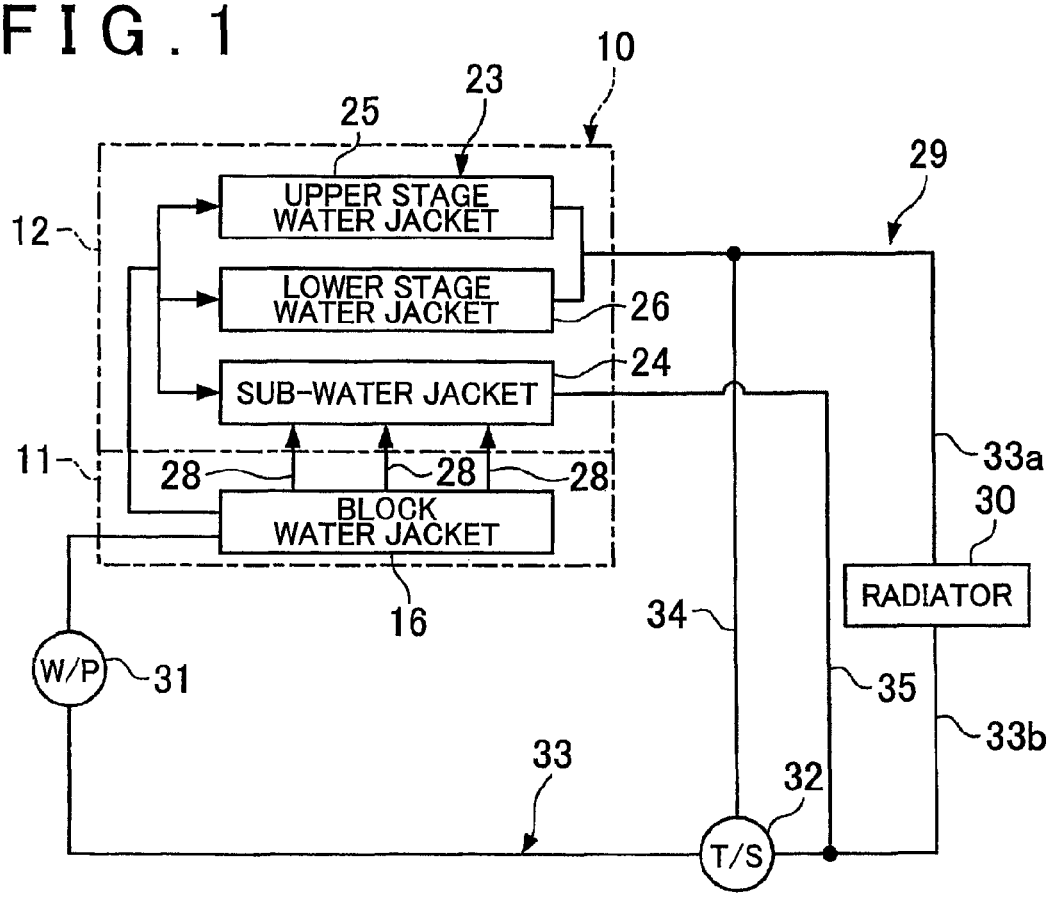
FIG. 1 is a view showing an embodiment of an internal combustion engine according to the present invention, and is a schematic structural diagram of the internal combustion engine and a cooling device.
Figure 2:
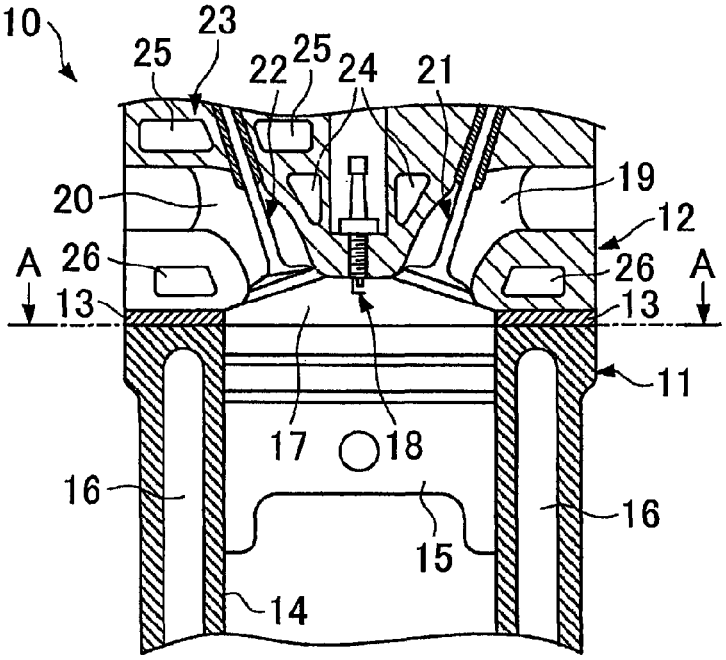
FIG. 2 is a view showing the first embodiment of the internal combustion engine according to the present invention, and is a sectional view of the internal combustion engine.

An embodiment of an internal combustion engine according to the present invention will be explained below using the drawings. FIG. 1 to FIG. 6 are views showing an embodiment of the internal combustion engine according to the present invention. First of all, a structure will be explained. In FIG. 1 and FIG. 2, an internal combustion engine 10 is, for example, a gasoline engine, and includes a cylinder block 11 and a cylinder head 12. The cylinder block 11 and the cylinder head 12 are fastened to each other by a head bolt (not shown) through a head gasket 13. The internal combustion engine 10 may also be a diesel engine, and so on.

Figure 3:
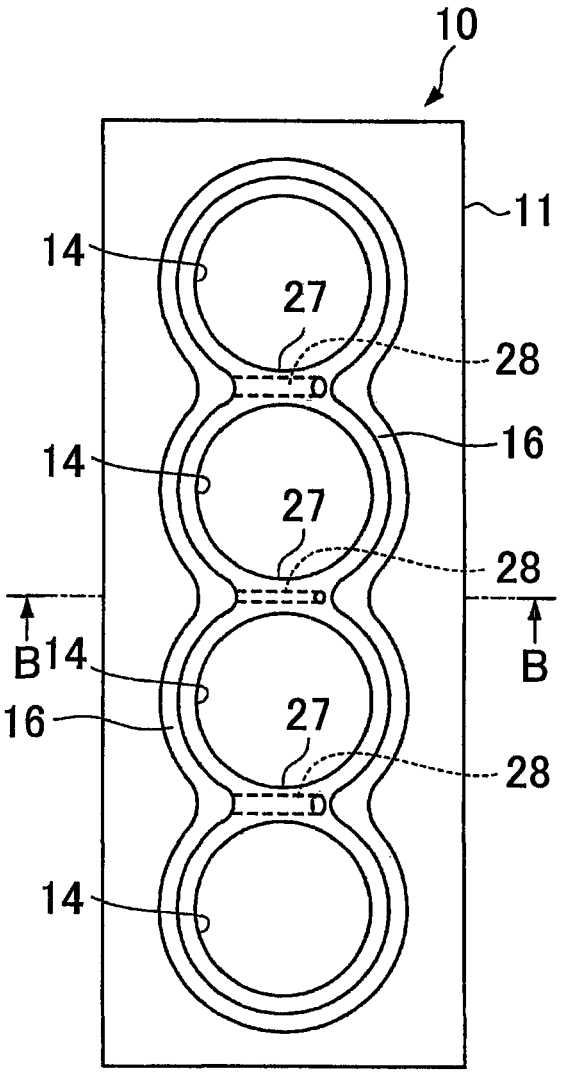
FIG. 3 is a view showing the first embodiment of the internal combustion engine according to the present invention, and is a sectional view taken along the arrows A-A in FIG. 2, showing a cylinder block of the internal combustion engine.

As shown in FIG. 2 and FIG. 3, in the cylinder block 11, a plurality of cylinder bores 14 (only one of them is shown in FIG. 2) is provided in line in a longitudinal direction of the cylinder block 11, and pistons 15 are inserted in the cylinder bores 14. In the cylinder block 11, a block water jacket 16 is formed as a block cooling water passage through which cooling water flows, and the block water jacket 16 is provided so as to surround the plurality of cylinder bores 14.

In FIG. 2, a combustion chamber 17 is provided in a space defined by upper parts of the cylinder bores 14 and a lower part of the cylinder head 12, and a spark plug 18 is attached to the cylinder head 12 so as to face the combustion chamber 17.

An inlet port 19 and an exhaust port 20 are connected with the combustion chamber 17. An inlet valve 21 is provided between the inlet port 19 and the combustion chamber 17, and, as the inlet valve 21 is driven to open and close, the inlet port 19 and the combustion chamber 17 are communicated with or blocked from each other.

Also, an exhaust valve 22 is provided between the exhaust port 20 and the combustion chamber 17, and, as the exhaust valve 22 is driven to open and close, the exhaust port 20 and the combustion chamber 17 are communicated with or blocked from each other. The inlet valve 21 and the exhaust valve 22 are driven to open and close by rotation, of an inlet camshaft and an exhaust camshaft to which rotation of a crankshaft (not shown) is transmitted.

In the cylinder head 12, a water jacket is formed, through which cooling water flows. The water jackets of the cylinder head 12 are structured by including main water jackets 23 that structure a first cooling water passage, and a sub-water jacket 24 that structures a second cooling water passage.

The main water jackets 23 are structured by including an upper stage water jacket 25 serving as an upper stage cooling water passage that is formed around the exhaust valve 22, and a lower stage water jacket 26 that is provided in a region around the inlet port 19 and the exhaust port 20 and adjacent to the combustion chamber 17 that is defined by the upper parts of the cylinder bores 14 and the lower part of the cylinder head 12.

Upstream sides of the upper stage water jacket 25 and the lower stage water jacket 26 are communicated with each other, thus forming a joining part, and the joining part is communicated with a downstream side of the block water jacket 16 of the cylinder block 11. Therefore, cooling water is introduced from the block water jacket 16 into the upper stage water jacket 25 and the lower stage water jacket 26.

A flow passage area of the lower stage water jacket 26 is formed to be smaller than a flow passage area of the upper stage water jacket 25, and flow velocity of cooling water flowing through the lower stage water jacket 26 becomes higher than flow velocity of cooling water flowing through the upper stage water jacket 25.

Figure 4:
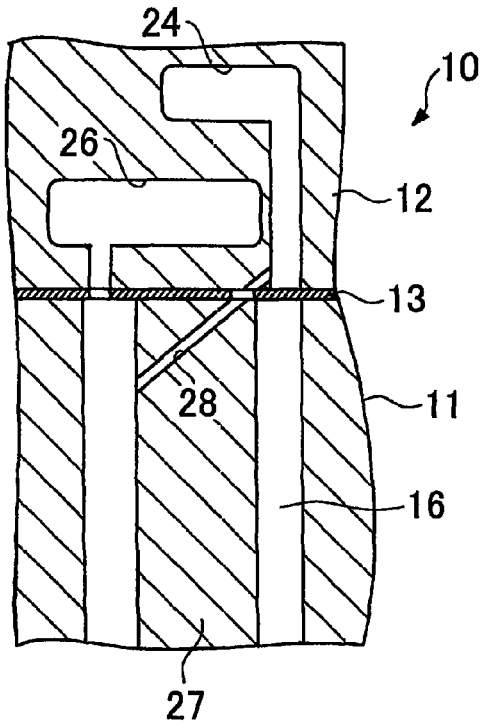
FIG. 4 is a view showing the first embodiment of the internal combustion engine according to the present invention, and includes a sectional view of the cylinder block taken along the arrows B-B in FIG. 3, and a sectional view of a cylinder head taken along the same direction.

Also, as shown in FIG. 3 and FIG. 4, a inter-bore cooling water passage 28 provided between cylinder bores 14 is formed by a drill or the like in a thin part (hereinafter, referred to as a part between cylinder bores 27) of the cylinder block 11 between the cylinder bores 14, an upstream end of the inter-bore cooling water passage 28 is communicated with the block water jacket 16.

The sub-water jacket 24 is provided independently from the main water jackets 23 so as not to be communicated with the main water jackets 23. The sub-water jacket 24 is provided so as to surround the spark plug 18 (see FIG. 2), and is also communicated with a downstream end of the inter-bore cooling water passage 28 (see FIG. 4).

In FIG. 1, a cooling device 29 is provided in the internal combustion engine 10, and the cooling device 29 is structured from a radiator 30 serving as a heat exchanger, an electric water pump 31, and a thermostat 32, as well as piping where cooling water flows through among the radiator 30, the electric water pump 31 and the thermostat 32.

In FIG. 1, although the positional relationship among the sub-water jacket 24, the lower stage water jacket 26, and the upper stage water jacket 25 is different from that in FIG. 2, an actual positional relationship is illustrated as FIG. 2.

Downstream sides of the upper stage water jacket 25 and the lower stage water jacket 26 of the cylinder head 12 are communicated with each other, thus forming the joining part, and the joining part is connected with main piping 33. On the main piping 33, the radiator 30, the electric water pump 31, and the thermostat 32 are provided, and cooling water flown out from the upper stage water jacket 25 is supplied to the radiator 30.

In the internal combustion engine 10 according to this embodiment, a part of the main piping 33, which communicates the upper stage water jacket 25 and the lower stage water jacket 26 with the radiator 30, structures a piping portion 33*a* that structures a first cooling water introducing part.

The radiator 30 is provided with a tube, through which cooling water flows, and a fin that is provided in the tube, and has a cooling function for cooling water by exchanging heat between cooling water flowing through the tube and air that serves as a coolant.

An upstream end of a bypass piping 34 is connected with the piping portion 33*a*, and a downstream end of the bypass piping 34 bypasses the radiator 30 and is connected with the thermostat 32 on a downstream side of the radiator 30.

The thermostat 32 is designed to adjust an amount of cooling water that flows through the radiator 30 and an amount of cooling water that flows through the bypass piping 34. For example, the thermostat 32 has functions to accelerate warming up of the internal combustion engine 10 by increasing an amount of cooling water in the bypass piping 34 during the warming up of the internal combustion engine 10, and to improve cooling performance of the internal combustion engine 10 after the warming up is completed, by reducing the amount of cooling water on the side of the bypass piping 34, or, keeping cooling water on the side of the bypass piping 34 so that cooling water does not bypass the radiator 30.

Also, cooling water flown out from the downstream side of the sub-water jacket 24 is introduced to sub piping 35 serving as a second cooling water introducing part, and the downstream end of the sub piping 35 in the main piping 33 is connected with piping portion 33*b* that connects the radiator 30 with the thermostat 32. Therefore, cooling water flown out from the sub-water jacket 24 is lead to the piping portion 33*b* on the downstream side of the radiator 30 so as to avoid the radiator 30.

The electric water pump 31 makes cooling water circulate in the internal combustion engine 10 through the main piping 33 and the sub piping 35, and is driven by a control circuit (not shown). Here, instead of the electric water pump 31, a mechanical water pump driven by the crankshaft of the internal combustion engine 10 may be used.

Next, effects will be explained. During warming up of the internal combustion engine 10, after cooling water flowing through the block water jacket 16 is introduced into the lower stage water jacket 26 and the upper stage water jacket 25, the cooling water is flown out from the lower stage water jacket 26 and the upper stage water jacket 25 into the piping portion 33*a*.

Cooling water flowing through the block water jacket 16 flows into the sub-water jacket 24 through the inter-bore cooling water passage 28, and thereafter, is flown out from the sub-water jacket 24 into the sub piping 35.

Since temperature of cooling water is low for the warming up operation for the internal combustion engine 10, the cooling water is lead to the internal combustion engine 10 through the bypass piping 34 by the thermostat 32, thus accelerating warming up of the internal combustion engine 10.

Also, since temperature of cooling water becomes high after warming up of the internal combustion engine 10 is finished, cooling water flown out from the lower stage water jacket 26 and the upper stage water jacket 25 is lead to the radiator 30, and cooling water cooled by the radiator 30 is introduced into the internal combustion engine 10 through the main piping 33.

Further, cooling water flown out from the sub-water jacket 24 avoids the radiator 30 and is lead to the piping portion 33*b*, but the temperature of the cooling water is reduced as the cooling water is mixed into low-temperature cooling water that has been cooled by the radiator 30.

Therefore, the cylinder bores 14 and the part between cylinder bores 27 of the cylinder block 11, and the cylinder head 12 are cooled by low-temperature cooling water.

Meanwhile, since the inter-bore cooling water passage 28 has a small diameter as the inter-bore cooling water passage 28 is formed in the thin part between cylinder bores 27, the larger differential pressure between the upstream side and the downstream side of the inter-bore cooling water passage 28 becomes, the more flow velocity of cooling water flowing through the inter-bore cooling water passage 28 is increased, thus increasing a flow rate of the cooling water.

When the upper stage water jacket of the cylinder head and the block water jacket of the cylinder block are communicated with each other through the inter-bore cooling water passage like the conventional example, cooling water, which is lead from the lower stage water jacket to, the upper stage water jacket and flown out from the upper stage water jacket, is introduced into the radiator, so flow resistance is increased when cooling water flows through the radiator. Therefore, it is not possible to further increase differential pressure between the upper stage water jacket and the block water jacket.

In order to increase different al pressure between cooling water flowing through the block water jacket and cooling water flowing through the upper stage water jacket, shapes of the block water jacket, the upper stage water jacket, and the lower stage water jacket need to be such shapes that increase differential pressure between cooling water flowing through the block water jacket and cooling water flowing through the upper stage water jacket.

However, when the shapes of the block water jacket, the upper stage water jacket, and the lower stage water jacket become such shapes that increase differential pressure between cooling water flowing through the block water jacket and cooling water flowing through the upper stage water jacket, the shapes of the block water jacket, the upper stage water jacket, and the lower stage water jacket become complex.

As the shapes become complex as stated above, a loss of pressure in cooling water flowing through the block water jacket, the upper stage water jacket, and the lower stage water jacket is increased, and cooling performance of the internal combustion engine 10 can be deteriorated. Hence, in this regard, it is impossible to increase differential pressure between the upper stage water jacket and the block water jacket.

Moreover, when supplying cooling water to the block water jacket from the electric water pump, if it is difficult to increase discharge capacity of the electric water pump, a total amount of cooling water supplied to the internal combustion engine during high-speed rotation of the internal combustion engine is reduced. Therefore, cooling water supplied to the inter-bore cooling water passage is also reduced. From the results stated above, cooling performance between cylinder bores is deteriorated.

Once cooling performance between cylinder bores is deteriorated, temperature of the cylinder block becomes high, reducing strength of the cylinder block is reduced, and, at the same time, durability of the head gasket is deteriorated, thus degrading sealability between the cylinder block and the cylinder head. In addition to this, temperature of lubricating oil that lubricates the pistons 15 becomes high, and viscosity is reduced, which may degrade lubricity of the pistons 15.

On the contrary, the internal combustion engine 10 of this embodiment is provided with the cylinder block 11 having the block water jacket 16 that supplies cooling water to be supplied to the cylinder bores 14, and the inter-bore cooling water passage 28 that supplies cooling water to the part between cylinder bores 27, and the cylinder head 12 having the main water jackets 23 to which cooling water is supplied from the block water jacket 16, and the sub-water jacket 24 which is provided independently from the main water jackets 23 and, to which cooling water is supplied from the inter-bore cooling water passage 28.

Also, the internal combustion engine 10 is provided with the piping portion 30*a* that leads cooling water, which is flown out from the main water jackets 23, to the radiator 30, and the sub piping 35 that leads cooling water, which is flown out from the sub-water jacket 24, to the downstream side of the radiator 30.

Therefore, cooling water flown out from the main water jackets 23 receives resistance of the tube of the radiator 30, and cooling water flown out from the sub-water jacket 24 does not receive resistance of the tube of the radiator 30.

Therefore, it is possible to reduce flow resistance of cooling water flowing through the sub-water jacket 24 to be smaller than flow, resistance of cooling water flowing through the main water jackets 23, and it is possible to increase differential pressure between the block water jacket 16 and the sub-water jacket 24 to be larger than differential pressure between the block water jacket 16 and the main water jackets 23.

In other words, in the internal combustion engine 10 according to this embodiment, as the sub-water jacket 24, which is dedicated to reduce flow resistance of cooling water flowing out from the inter-bore cooling water passage 28, is provided in the internal combustion engine 10, it is possible to increase differential pressure between the upstream side (the cylinder block 11) and the downstream side (the cylinder head 12) of the inter-bore cooling water passage 28, compared to the case where the inter-bore cooling water passage 28 is communicated with the main water jackets 23.

As a result, it is possible to increase flow velocity of cooling water flowing through the inter-bore cooling water passage 28 and thus increase a flow rate of cooling water flowing through the inter-bore cooling water passage 28, thereby improving cooling performance for the part between cylinder bores 27, the temperature of which becomes high.

As stated so far, in the internal combustion engine 10 according to this embodiment, since it is possible to improve cooling performance for the part between cylinder bores 27, it is possible to prevent deterioration of strength of the cylinder block 11, and, it is also possible to prevent deterioration of sealability between the cylinder block 11 and the cylinder head 12 caused by deterioration of durability of the head gasket 13. In addition, it is possible to prevent a reduction in viscosity of lubricating oil by restraining an increase in temperature of the lubricating oil that lubricates the pistons 15, thus preventing deterioration of lubricity of the pistons 15.

Further, in the internal combustion engine 10 according to this embodiment, the main water jackets 23 are structured by the lower stage water jacket 26 provided adjacent to the combustion chamber 17, and the upper stage water jacket 25 that is communicated with the lower stage water jacket 26 and provided above the lower stage water jacket 26, and the piping portion 33*a* is structured by a thing that leads cooling water, which is flown out form the upper stage water jacket 25, to the radiator 30.

Therefore, by reducing a flow passage area of the upper stage water jacket 25 to be smaller than a flow passage area of the lower stage water jacket 26, it is possible to increase flow velocity of the cooling water flowing through the lower stage water jacket 26. Hence, it becomes possible to proactively cool a part of the cylinder head 12 adjacent to the combustion chamber 17, the temperature of which becomes high, and it is possible to improve cooling performance for the cylinder head 12.

Figure 5:
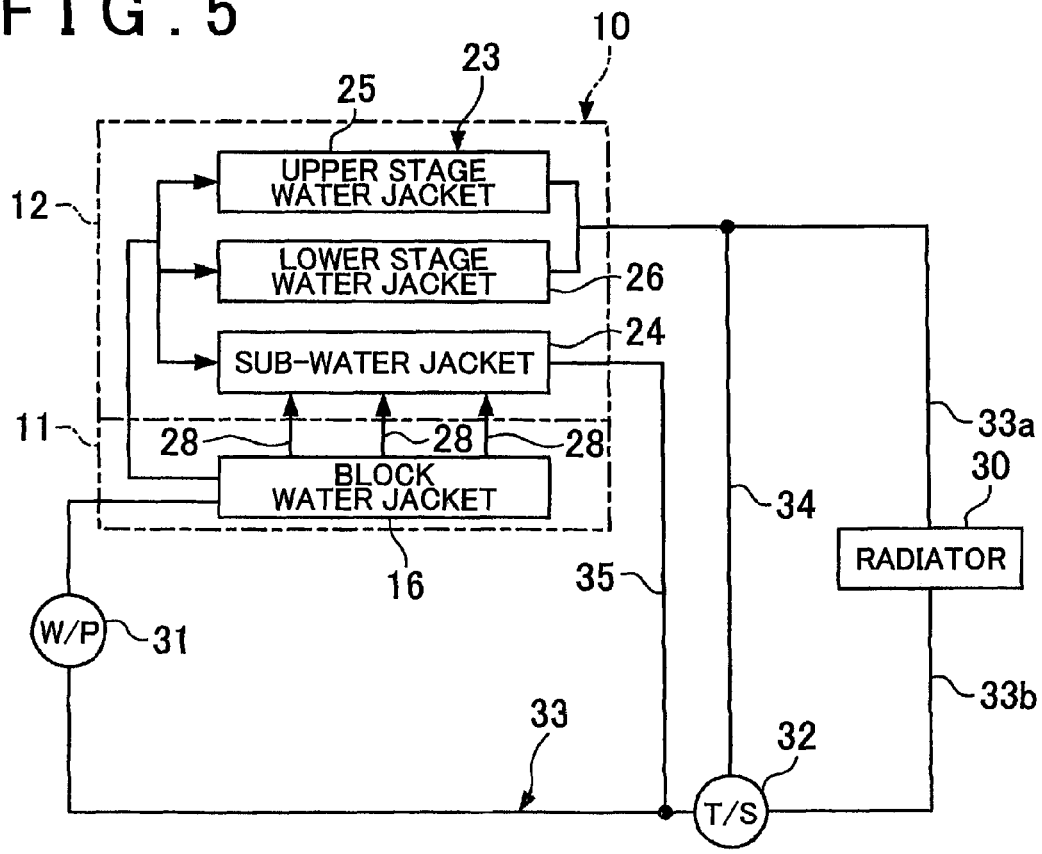
FIG. 5 is a view showing the first embodiment of the internal combustion engine according to the present invention, and is a schematic structural diagram of the internal combustion engine and a cooling device having another structure.

In the internal combustion engine 10 according to this embodiment, although the downstream end of the sub piping 35 is connected with the piping portion 33*b* of the main piping 33 on the upstream side of the thermostat 32, the downstream end of the sub piping 35 may be connected with the main piping 33 on the downstream side of the thermostat 32, as shown in FIG. 5.

By doing so, it becomes possible to introduce cooling water, which is flown out from the sub-water jacket 24, into the main piping 33 while avoiding the radiator 30 and the thermostat 32, and therefore, it becomes possible to reduce flow resistance of cooling water flowing through the sub-water jacket 24 even more, thus enabling to effectively increase differential pressure between the block water jacket 16 and the sub-water jacket 24 to be larger than differential pressure between the block water jacket 16 and the main water jackets 23.

Figure 6:
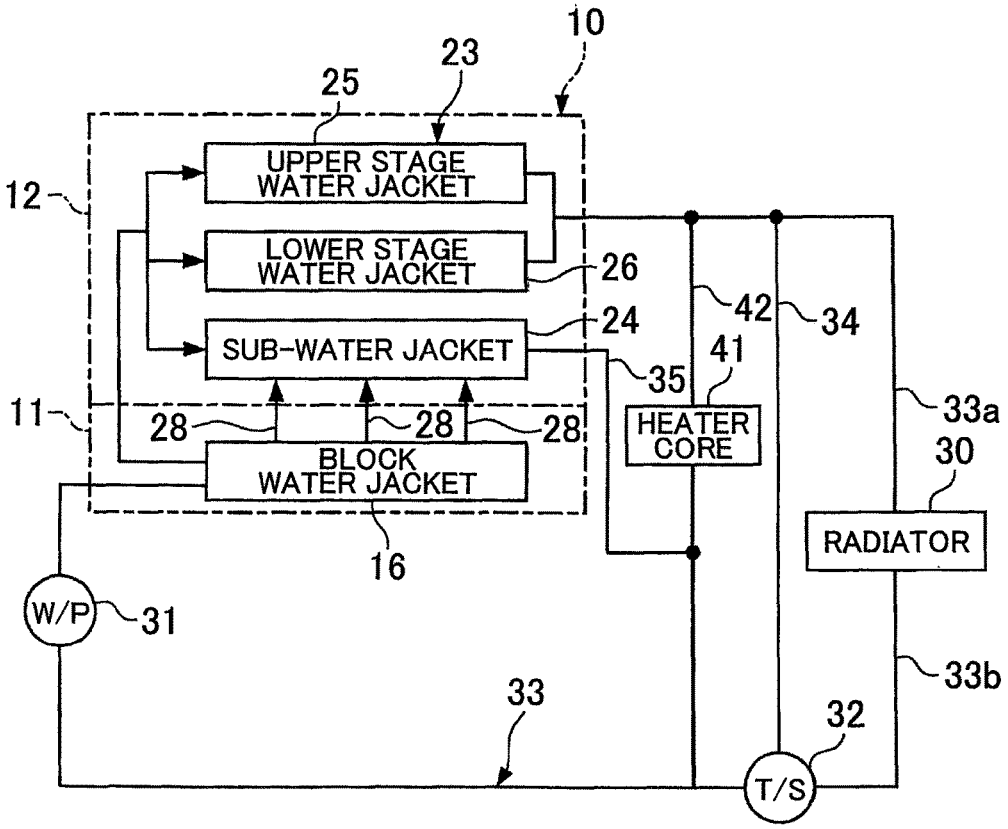
FIG. 6 is a view showing the first embodiment of the internal combustion engine according to the present invention, and is a schematic structural diagram of the internal combustion engine and a cooling device having another structure.

In addition, as shown in FIG. 6, heater piping 42 having a heater core 41 may be arranged between the piping portion 33*a* of the main piping 33 and the main piping 33 on the downstream side of the thermostat 32 so as to connect the downstream end of the sub piping 35 with the heater piping 42.

With such a structure, it is also possible to supply cooling water, flown out from the sub-water jacket 24, to the main piping 33 while avoiding the radiator 30. In the internal combustion engine 10 according to this embodiment, although the main water jackets 23 are structured from the upper stage water jacket 25 and the lower stage water jacket 26, the main water jacket may also be structured by a plurality of water jackets arranged at generally the same height. The number of the main water jacket may be, one.

As stated so far, the internal combustion engine according to the present invention has effects to increase a flow rate of cooling water flowing through the inter-bore cooling water passage, and improve cooling performance between cylinder bore, and is useful as an internal combustion engine and so on having a cylinder head with a plurality of independent cooling water passages.

What is claimed is:

1. An internal combustion engine comprising:

a cylinder block having a block cooling water passage configured to supply cooling water to a plurality of cylinder bores, and an inter-bore cooling water passage provided between cylinder bores, the inter-bore cooling water passage being configured to supply cooling water between the cylinder bores;

a cylinder head having a first cooling water passage to which cooling water is supplied from the block cooling water passage, and a second cooling water passage, the second cooling water passage being provided independently from the first cooling water passage, and the second cooling water passage being configured such that cooling water is supplied from the inter-bore cooling water passage to the second cooling water passage;

a heat exchanger;

a first cooling water introducing part configured to lead cooling water, which is flown out from the first cooling water passage, to the heat exchanger; and a second cooling water introducing part configured to lead cooling water, which is flown out from the second cooling water passage, to a downstream side of the heat exchanger.

2. The internal combustion engine according to claim 1, wherein the first cooling water passage includes a lower stage cooling water passage that is provided adjacent to a combustion chamber defined by upper portions of the cylinder bores and a lower portion of the cylinder head, and an upper stage cooling water passage that is communicated with the lower stage cooling water passage and provided above the lower stage cooling water passage, and the first cooling water introducing part is configured to lead cooling water, which is flown out from the upper stage cooling water passage and the lower stage cooling water passage, to the heat exchanger.

3. The internal combustion engine according to claim 1, wherein the heat exchanger is a radiator that has a tube through which cooling water flows, and the heat exchanger is configured to exchange heat between a coolant and the cooling water.

* * * * *